United States Patent [19]

Bouteille et al.

[11] Patent Number: 4,690,035

[45] Date of Patent: Sep. 1, 1987

[54] EMERGENCY DRAINING DEVICE FOR STOPPING PNEUMATIC CYLINDERS

[75] Inventors: Daniel Bouteille, Ville d'Avray; Michel Nicolas, Neauphle le Chateau; Daniel Guillin, Sannois, all of France

[73] Assignee: La Telemecanique Electrique, France

[21] Appl. No.: 912,700

[22] Filed: Sep. 29, 1986

Related U.S. Application Data

[63] Continuation of Ser. No. 686,510, Dec. 26, 1984, abandoned.

[30] Foreign Application Priority Data

Jan. 17, 1984 [FR] France ..... 84 00652

[51] Int. Cl.[4] ..... F01B 3/00

[52] U.S. Cl. ..... 91/442; 91/448; 91/450; 91/461; 91/464

[58] Field of Search ..... 137/877, 884, 471, 472, 137/843, 842; 91/442, 461, 448, 450, 464

[56] References Cited

U.S. PATENT DOCUMENTS

| | | | |
|---|---|---|---|
| 1,506,012 | 8/1924 | Lewis | 137/102 |
| 1,726,102 | 8/1929 | Forman | 91/442 X |
| 3,099,136 | 7/1963 | Carlson | 91/442 X |
| 3,187,637 | 6/1965 | Edmund | 91/442 X |
| 3,960,059 | 6/1976 | Schexnayder | 91/461 |
| 4,475,442 | 10/1984 | Breeden | 91/461 |

*Primary Examiner*—Edward K. Look

*Attorney, Agent, or Firm*—William A. Drucker

[57] ABSTRACT

An emergency drain device for pneumatic cylinders which is integrated in an orientatable connection fixed directly to the cylinder body and comprises a valve which closes an orifice of the bolt of the connection, going to the atmosphere, when a control pressure is applied to the head of the bolt.

This device is advantageously used in installations where a general isolating switch, controlled by the same control pressure, connects the general distribution line to the atmosphere, for example in the case of an emergency, when said pressure disappears.

3 Claims, 6 Drawing Figures

EMERGENCY DRAINING DEVICE FOR STOPPING PNEUMATIC CYLINDERS

This application is a continuation of application Ser. No. 686,510, filed Dec. 26, 1984, now abandoned.

BACKGROUND OF THE INVENTION

1. Field of the Invention

The present invention relates to an emergency draining device for pneumatic cylinders, which is intended to cause the stopping thereof and which comprises:

a pressurized fluid supply inlet which is connected directly or indirectly to a pneumatic distributor, a fluid outlet, which is connected to a chamber of the cylinder, and a control inlet, which receives a control signal acting on an internal switching means adapted to connect the fluid outlet to the atmosphere or not, the inlet and the outlet being in communication when this signal is absent.

2. Description of the Prior Art

Such devices may be used in all pneumatic installations, either for stopping the movement of the actuating rods of cylinders, for example when a danger occurs, or for making manual actuation of the rod of this cylinder possible, for carrying out a checking or adjusting operation.

Rapid draining circuits are already known for cylinders which, so as to obtain the above mentioned draining possibility, use a monostable 3/2 distributor; this 3/2 distributor is placed between a chamber of the cylinder and a normal pneumatic distributor so that, in the presence of a control signal, the chamber of the cylinder is connected to the distributor, whereas, in the absence of this signal, the chamber is connected to exhaust and so that the duct coming from the normal distributor is closed.

We cannot really speak here of a device specially adapted to the desired function to the extent that this 3/2 distributor is designed for more general functions and has a form adapted thereto.

The fitting and use of such a distributor has the disadvantage, on the one hand, of requiring much time and, on the other hand, in resulting in cumbersome assemblies. When the above mentioned fitting is finished, the presence of this 3/2 distributor in the vicinity of the cylinder is not appreciated by users to the extent that it results in a piling up of members which obviously have not been designed for this purpose.

Furthermore, the fitting of these 3/2 distributors, which is justified when speed regulators are associated with the cylinder, means that they are placed between the cylinders and said regulators. Because of the modern tendency to generalize the use of speed regulators incorporated in connections fitted directly to the cylinder body, the use of these 3/2 distributors for the above mentioned purposes has become obsolete.

The need to stop a cylinder instantly or to make it operable by hand is often met with in industrial installations where it is either indispensable to limit the damage and the risks which malfunctions may cause or it is necessary before starting up or after repairing.

A pneumatic cylinder can only be stopped and placed in a neutral position if the pressures which are exerted on the two faces of its piston disappear after decreasing simultaneously.

Since the cylinders are supplied from ducts which connect them to distributors and since these latter are themselves connected to a compressed air source, often a distance away, by a general line and to an exhaust manifold, it is sometimes difficult to rapidly empty or drain the cylinder by interrupting the inlet of fluid in the general line and draining this latter.

Such symmetrical draining is even longer and more difficult to obtain if, as is frequently the case, the air escapes from the cylinder to the distributor through one or more flow limiting means. In this latter case, it can be observed that, since the masses of compressed air contained on each side of the piston escape at different rates, they continue to exert on this piston different pressures which prolong the movement thereof after the pneumatic isolating switch has been opened.

It is also known that a 3/2 modular pneumatic isolating switch may be used for venting to the atmosphere a pressurized supply line serving a multiplicity of distributors, each associated with a respective cylinder; such an isolating switch, which at the same time interrupts the intake of pressurized fluid from the source in the general line and connects this latter to the atmosphere, is always placed at the head of this line, so that the delay in draining must be taken into account which is due to the line lengths, distributors and flow limiters mentioned above.

SUMMARY OF THE INVENTION

The invention consequently provides a simple, inexpensive and compact draining device for a pneumatic cylinder which is capable of causing the air which it contains to be discharged very rapidly at the moment when, exceptionally, an opening signal controlling the interruption of the compressed air supply is applied to an installation, and in particular when this opening signal which switches a pneumatic isolating switch adapted for connecting the general distribution line to an exhaust after disconnecting this latter from the compressed air source, is represented by the disappearance of a pressure.

According to the invention, the aim sought is attained because this device has fixing means screwed directly into the cylinder body and comprises an internal channel connected to the supply inlet, to the fluid outlet and to an orifice communicating with an exhaust, said orifice being closed by a valve placed opposite when a closure force is exerted thereon created by the pressure of the fluid on the control inlet and this orifice being opened by the fluid exhausted from the chamber when the control pressure and the supply pressure disappear simultaneously.

Rapid drain devices have already been used between the cylinders and distributors for accelerating the movement of a cylinder when the circuit which supplies it does not have a sufficient caliber to ensure rapid displacement of the fluid, or when the distributor is far from the cylinder; such a device which is disposed close to the cylinder connects the chamber of the cylinder, evacuating its fluid, directly to the exhaust as soon as the distributor switches over; these devices use a valve which is placed opposite an orifice communicating with the atmosphere, and which is applied there against when the cylinder is pressurized, or raised by the fluid of the cylinder when this latter is being exhausted; Such a rapid drain device operates then continuously.

The objective sought by these rapid drain devices, as well as the embodiment thereof have nothing in common with those of the invention.

BRIEF DESCRIPTION OF THE DRAWINGS

Other features of the invention as well as a system for stopping the operation of a pneumatic installation using the device of the invention will be better understood from reading the following description and from the accompanying Figures in which.

DESCRIPTION OF THE PREFERRED EMBODIMENTS

Figure 1A:
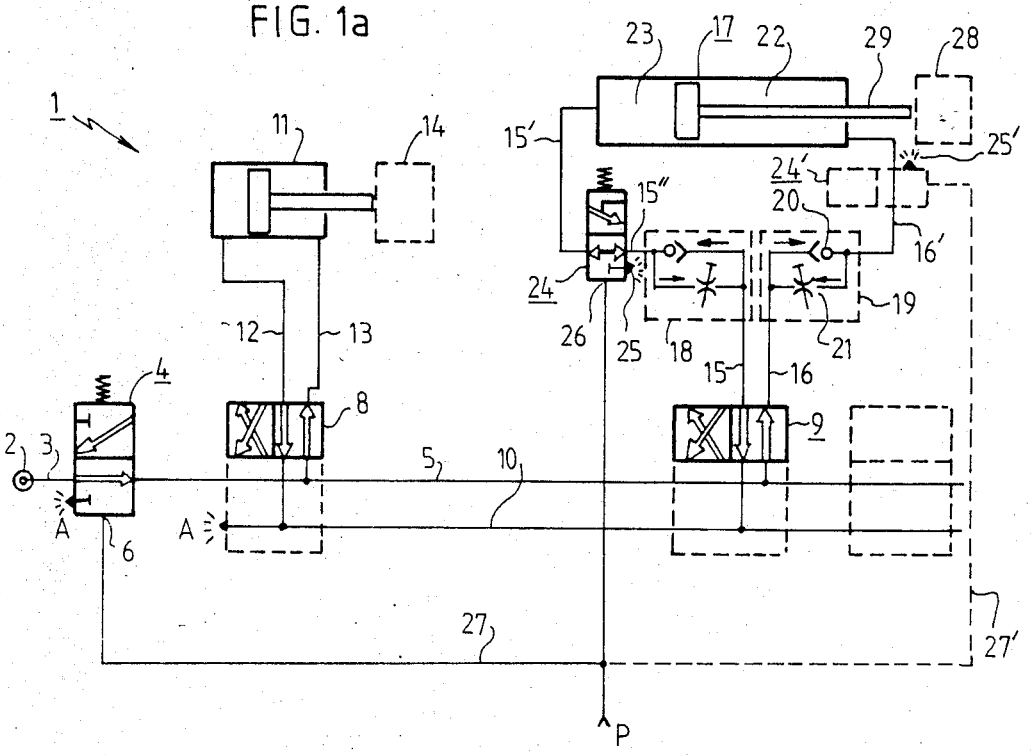
FIG. 1*a* shows schematically a pneumatic installation using the drain device of the invention in a normal operating phase.

In the installation 1 shown in FIG. 1*a*, the compressed air source 2 at a pressure "P" is connected by duct 3 to a general pneumatic isolating switch 4 which is shown here in its passing state, where it allows the fluid to flow to a general distribution duct 5. This passing state of the isolating switch, which is maintained when a control signal of pressure "P" is applied to its control inlet 6, is switched over when this signal disappears so that a connection is established between line 5 and a vent 7 opening to the atmosphere A (see FIG. 1*b*, in a non passing state).

The general distribution line, which may have a great length is connected at some of its points to distributors such as 8 and 9 which are also connected to an exhaust manifold 10. The first one 8 of these distributors supplies for example a first cylinder 11, without one or more speed regulating devices being placed in one of the supply ducts 12 or 13 so that the moving speed of the piston of this cylinder is essentially determined by the characteristics of the load 14 which it moves and by the pressure P.

The second distributor 9 is connected to a second cylinder 17 by ducts 15 and 16 which have speed regulators 18 respectively 19 in their path. These each comprise at least one adjustable constriction, such as 21, which is frequently placed in parallel across a one way valve such as 20.

It will be recalled that the function of such a speed regulator is to allow the fluid to move, either without hindrance from the distributor to the cylinder, or with a certain slowing down when the fluid escapes from the cylinder to the distributor.

In the state of the distributor shown in FIG. 1*a*, the piston tends to move leftwards for fluid penetrates into the right hand chamber 22.

Between the left hand chamber 23 and/or right hand chamber 22 of the cylinder and the speed regulator 18 and/or 19, there is placed directly on the cylinder a drain device in accordance with the invention 24, 24' whose internal construction is described below and whose function is to connect chamber 23, respectively 22, either to the speed regulator 18 respectively 19 in its active state, or to a vent 25 respectively 25' opening to the atmosphere in its passive state. The duct portion 15' shown in FIG. 1*a* between chamber 23 and the drain device is therefore as short as material conditions allow. The active state of the drain device 24 shown in FIG. 1*a* is obtained by applying to an inlet 26 a control signal of pressure "p", which is conveyed by the same line 27 as that connected to the inlets 6 of the general isolating switch.

When the installation is working normally, the speed of movement of the piston belonging to cylinder 17 is determined not only by the nature of load 28 but also by the speed regulators 18 and 19 which impose passage restrictions on the fluids coming from the chambers and going towards the exhaust manifold 10.

If a mishap occurs in the installation, and if it is necessary to interrupt the supply thereto, the control pressure "p" on line 27 is interrupted and becomes "$\bar{p}$" for example by using an emergency pneumatic stop switch not shown, and the general isolating switch 4 connects duct 5 to the atmosphere. Considering the immediate proximity of distributor 8, isolating switch 4 and cylinder 11, this latter drains its chambers very rapidly through ducts 12, 10 and 13, 5 so that the movement of the piston stops practically instantaneously.

On the other hand, if we examine operation of cylinder 17 which is remote from the isolating switch 4, it can be seen that the fact alone of connecting line 5 to the atmosphere through the general isolating switch 4 would not be sufficient, in the absence of the drain device 24, to cause the corresponding piston to stop instantaneously, on the one hand because of the existence of pressure losses in line 5 and, on the other, because of the presence of the speed regulators 18 and 19. In fact, the fluid which is enclosed in chamber 22 is compressed to a value very much greater than that which exists in chamber 23 and, if these pressures do not decrease while keeping identical values, which is rarely the case because of the different speeds which the cylinders must assume on the outgoing stroke and on the return stroke, the result is that the piston continues to move because of this pressure difference after the distribution line has been connected to atmosphere.

Figure 1B:
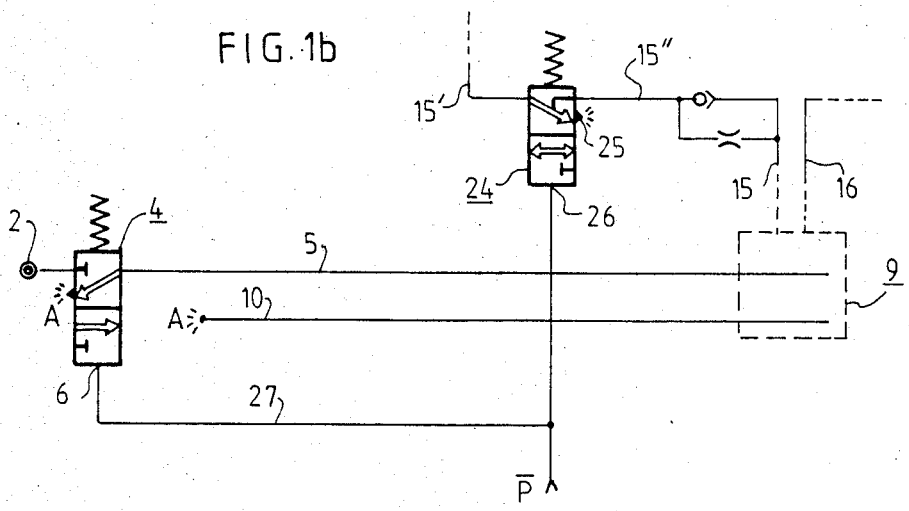
FIG. 1*b* shows a part of the members of FIG. 1*a* when a breakdown appears.

By placing one or two drain devices such as 24, 24' directly at the inlet or inlets of the cylinder, a short connection is made simultaneously and instantaneously from line 5 and chambers 22 and 23 to the atmosphere; the result is that the piston stops practically instantaneously in the position in which it is at the time when the pressure of the control signal "p" disappears, see FIG. 1*b*.

It can be further seen that the rapid drain condition of the cylinder does not cause a slow flow of the air contained in chambers 22 and 23 through the speed regulator or regulators 20, 21 when the rod 29 of the piston is to be operated by hand, for example for carrying out an adjustment or checking the positions which this rod may assume for, on the one hand, suction towards a chamber takes place in the passage direction of the non return valve and, on the other hand, the discharge from the other chamber escapes directly to the atmosphere.

It is clear that the pneumatic circuit of the installation which has just been described loses none of its interest if a single flow regulator is used and even if, in the absence of flow regulators, one or both ducts 15, 16 have a length such that the inherent pressure losses added to those of lines 5 and of manifold 10 slow down substantially the draining rate of the cylinder.

Figure 2:
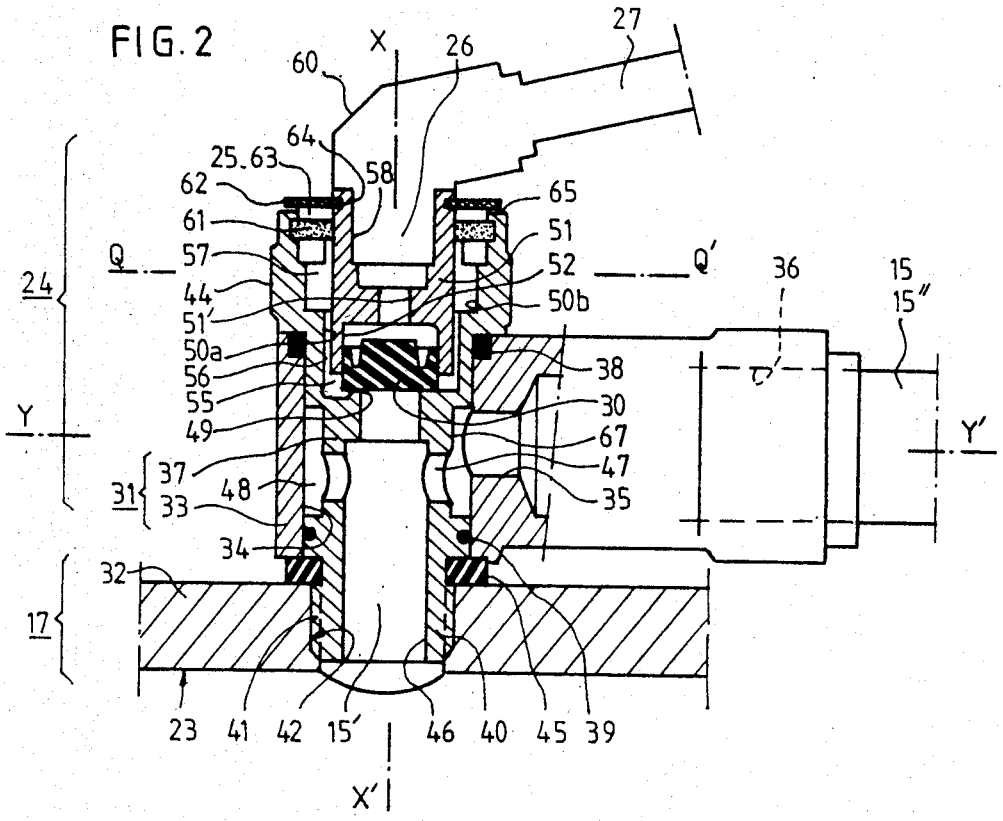
FIG. 2 illustrates in a section through a plane PP' an elevational view of a first embodiment of the drain device.

A drain device, according to a first embodiment such as 24, is in particular shown in FIG. 2 where, so as to reduce the length of the above mentioned duct 15' as much as possible, a controlled exhausting valve 30 has been combined with an orientatable connection of known type 31 which is fixed directly to the cylinder wall 32 of a pneumatic cylinder 17.

The orientatable connection comprises essentially a body 33 having a first through bore 34 with axis XX' and a second perpendicular bore 35 with axis YY' which communicates inwardly with the first one and which has outwardly means 36 for association with a duct such as 15, or such as 15'', if a speed regulating device (not shown) is placed between it and distributor 9. Bore 34 has passing therethrough a hollow bolt 37 which cooperates sealingly with the bore through seals 38, 39 and one end 40 of which has a threaded portion 41 for a sealing cooperation with a corresponding threaded portion 42 on wall 32, for example through a seal 45 or a tapered threaded portion, whereas an opposite end 43 has a tightening head 44 for example polygonal.

The bolt has a through channel 46 with axis XX' connected by openings 47 to an annular space 48 placed between it and bore 34. The region of this channel 46 opposite the threaded portion 41 opens through an orifice 49 into a cylindrical housing **50*a*, 50*b* which is formed in the head 44 and which receives a piece of revolution 51. This latter has an internal housing 52 which is placed opposite orifice 49 and which receives a valve 30 adapted for closing this latter by axial sliding XX' in housing 52. The outer surface 53 of this piece 51 travels parallel to housing 50*a* and has radial extensions 54 which are centered in housing 50*b* so as to make the axis of piece 51 coaxial with XX', see FIG. 3**.

Figure 3:
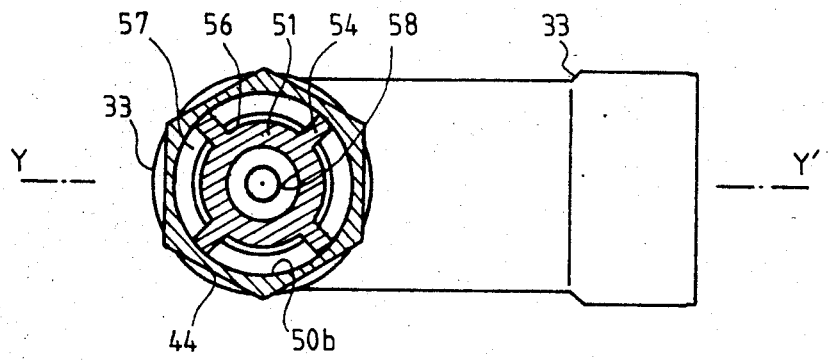
FIG. 3 shows in section through a plane QQ' of FIG. 2 a top view of the device shown in this Figure.

A first annular space 55 existing between the bottom of housing **50*a* and piece 51 as well as the second annular space 56 existing between housing 50*a* and piece 51 connect orifice 49 to the atmosphere 63 through radial spaces 57 placed between the radial extensions, see FIG. 3**.

The region of piece 51 opposite housing 52 has a second housing 58 which is connected to this latter and which receives a small orientatable connector 60 materializing the inlet 26 shown in FIG. **1*a*; this connector 60 is therefore connected to an external duct 27** in the form for example of a flexible plastic material tube.

The operation of the rapid drain device follows from the arrangement chosen, from the presence or absence of pressures in ducts 27 and 15, 15'' respectively in chamber 23 of cylinder 17 and from the ratio of the diameters of orifice 49 and housing 52.

If we assume, which is the most frequent case, that during filling of chamber 23 the pressure present in duct 27 is equal to the pressure in this chamber, closure of orifice 49 will be obtained by choosing for housing 52 a diameter greater than the diameter of this orifice. Thus, the drain device behaves like a conventional connection.

If, in accordance with the operating principle outlined above, the supply of fluid to duct 15, 15'' is interrupted and if the pressure in control line 27 is interrupted simultaneously the fluid present in chamber 23 will drain away to the atmosphere through spaces 55, 56, 57 due to the raising of valve 30 from orifice 49 which served as a seat therefor.

For reducing the intensity of noises during draining and the penetration of foreign bodies into the drain device through passages 55, 56 and 57, a filter 61 having a very low pressure loss for the drain fluid is placed in this latter passage. Should this pressure loss be even smaller, an annular protection valve 62 could replace the filter and be disposed above the outlet 63 of passage 57. Such a valve, which may be made from an elastomer foil, is advantageously fixed in a groove 64 of part 51, so as to bear resiliently on the periphery 65 of head 44 and to move away therefrom when the drain fluid raises it.

Figure 4:
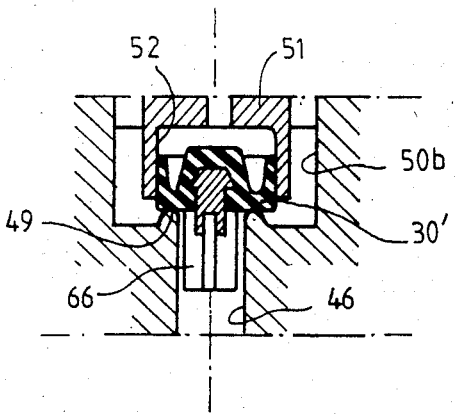
FIG. 4 illustrates a detail of the valve used in FIG. 2.

The movements of the free valve 30 which, in the embodiment shown in FIG. 2, are only guided by its resilient skirt, could also be guided by a rod 66 with cross shaped cross section fixed to a valve 30' and movable in channel 46, see FIG. 4.

It should be understood that, in order to reduce the outer dimensions of the device a certain number of these elements are preferably disposed in rod 67 of bolt 37; apart from its compactness, the advantages of the device remain the same if, for example, valve 30 is placed axially at the level of head 44; the sense of the bolt head must then be understood as the region opposite that which has the threaded portion.

Figure 5:
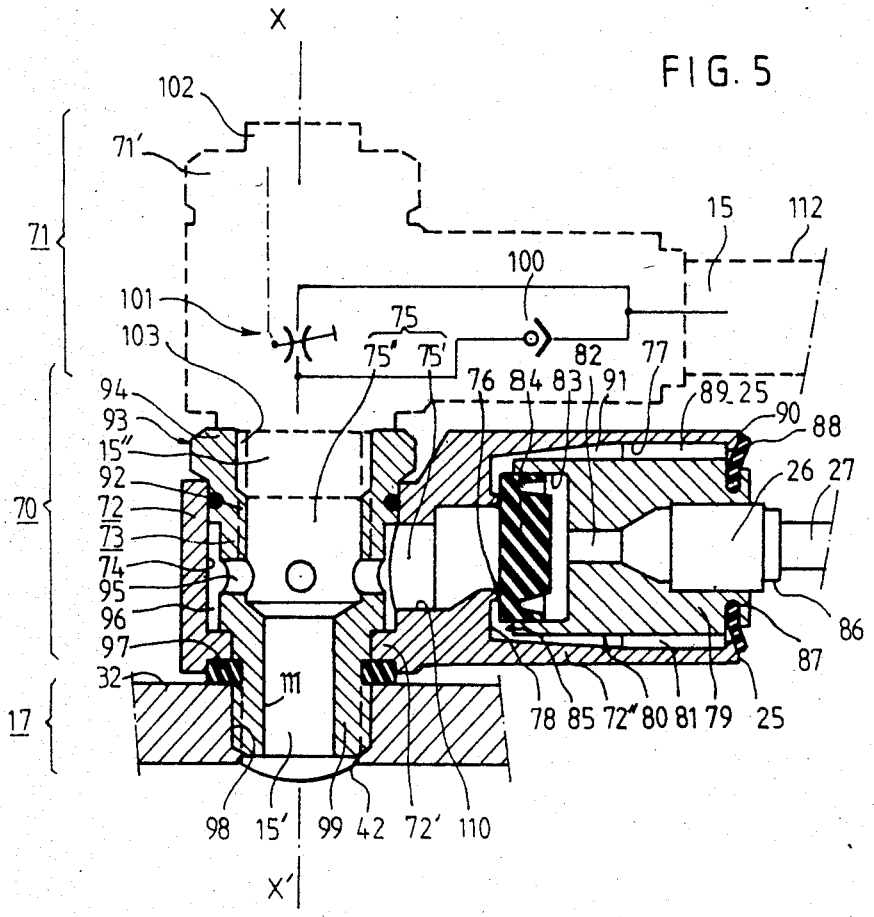
FIG. 5 shows in section an elevational view of a second embodiment of the drain device.

In a second embodiment shown in FIG. 5 the drain device 70 comprises a body 72 and a fixing bolt 73, on which a bent connection 71 may be mounted, containing for example a one way flow regulator 100, 101.

Body 72 has in a lug 72' a bore 74 with axis XX' which passes therethrough and in a lateral extension 72'', a bore 110 with axis YY', perpendicular to XX', which opens both into the first bore and, through an orifice 76 to a concentric housing 77 communicating with the outside.

In this housing is fixed a cylindrical piece 79, for example by means of radial projections 89 which are applied to the internal surface 77 of the housing and which leave between them and the external surface 80 of this piece passages 81, 91.

This piece has an internal end 85 which is at a certain distance from bottom 78 of the housing and which has a cylindrical housing 83 in which an elastomer valve 84 is sealingly and slidingly housed.

An internal channel 82 in piece 79 communicates with housing 83 and with a quick fit pneumatic connector 86 which is fitted on the opposite end 90 for receiving a duct 27, for example a flexible duct.

Bore 74 has passing therethrough a hollow fixing bolt 73 which has an internal channel 111 concentric to XX'. This channel communicating through apertures 95 with an annular space 96 situated between bore 74 and the external surface of the facing bolt, has a threaded portion 92 at a first upper end.

The bolt has an upper head 94, with, for example hexagonal faces 93 for accomodating a tightening tool, and an end 99 having a threaded portion 98.

Because of the interpositioning of seals such as 97', 97'', the bolt may be tightened sealingly in an opening 42 in wall 32 of a cylinder 17. Bores 110 and 111 represent respectively portions 75' and 75'' of an internal channel 75 of the drain device.

The points mentioned at 15'', 15' and 26 correspond to those of FIG. **1*a*** and correspond respectively to the pressure inlet, to the pressure outlet and to the control inlet.

A conventional bent connection 71, itself having a hollow connecting bolt 71', may be screwed and fixed sealingly by this latter in the tapped portion 92 in bolt 73.

These connections frequently have nowadays a flow regulator such as 101, adjusted by the adjusting knob 102 and a one way valve 100, these parts being shown here symbolically.

A pipe 112 is connected to this connection at a point 15, which corresponds to that shown in FIG. 1*a* and which is therefore supplied by a pneumatic distributor such as 9.

As in the preceding embodiment, a filter 62' may be disposed between passages 81, 91 and the exhaust 89; in a variant, exhaust 89 may be protected, as in the preceding embodiment, by a flexible annular part 88 similar to 62.

The operation of the second embodiment is identical to the preceding one, that is to say that when a control signal pressure is applied to point 26, valve 84 closes orifice 76 because the diameter of housing 83 has been chosen sufficiently large with respect to that of the orifice to withstand the force which is applied thereto over the area of the orifice.

A pressure applied at 15 travels then through the one way valve 100 and passes through points 15" and 15' for supplying the cylinder; when, in order to obtain a reverse movement of the piston of the cylinder, point 15 is connected to the exhaust, the chamber 113 of the cylinder empties through 15' and 15" through the speed regulator 101.

If the pressure of the control signal and that which is present at 15 disappear simultaneously, since the fluid present in chamber 113 cannot escape rapidly through the speed regulator, or because of any other pressure loss in duct 112 and in its extensions, its pressure raises valve 84 and therefore connects this chamber to the atmosphere through the shortest path 25.

What is claimed is:

1. The combination of a pneumatic cylinder having at least one working chamber formed in a cylindrical body and control means for effecting supply and release of fluid under pressure selectively to and from said working chamber, said control means comprising:

pneumatic distributor means having a power inlet connected to a source of fluid pressure, an outlet and a control inlet connected to a control pneumatic conduit adapted to transmit a control signal of pressure;

an emergency drain device having a pressurized fluid supply inlet, a fluid outlet, means for connecting the said fluid outlet to said working chamber, a control chamber having control inlet means, an internal chamber permanently connected to the supply inlet and to the fluid outlet and having a by-pass channel portion in controllable communication with an exhaust connected to the atmosphere and a valve member movable in said control chamber, said valve member being actuated by said control signal of pressure and cooperating with said by-pass channel portion for controlling the said communication;

means connecting the outlet of the pneumatic distributor means to the pressurized fluid inlet of said emergency drain device, and conduit means connecting said control inlet means of said emergency drain device to said pneumatic control conduit, said valve member being pushed by said control signal of pressure in a first position in which said communication is closed and being pushed in a second position by a transitory pressure which remains in said internal chamber when the control signal of pressure in the control pneumatic conduit is cancelled.

2. The combination of a pneumatic cylinder having at least one working chamber formed in a cylindrical body and control means for effecting supply and release of fluid under pressure selectively to an from said working chamber, said control means comprising:

i. pneumatic distributor means having a power inlet connected to a source of fluid pressure, an outlet and a control inlet connected to a control pneumatic conduit adapted to transmit a control signal of pressure;

ii. an emergency drain device having a pressurized fluid supply inlet, a fluid outlet, means for connecting the said fluid outlet to said working chamber, a control chamber, having control inlet means, an internal chamber permanently connected to the supply inlet and to the outlet and having a by pass channel portion in controllable communication with an exhaust connected to the atmosphere and a valve member movable in said control chamber, said valve member being actuated by said control signal of pressure and cooperating with said by-pass channel portion for controlling the said communication;

iii. means connecting the outlet of the pneumatic distributor means to the pressurized fluid inlet of said emergency drain device, and iv. conduit means connecting said control inlet means of said emergency drain device to said pneumatic control conduit, said valve member being pushed by said control signal of pressure in a first position in which said communication is closed and being pushed in a second position by a transitory pressure which remains in said internal chamber when the control signal of pressure in the control pneumatic conduit is cancelled, wherein said emergency drain device comprises:

i. an elongate hollow body which forms the pressurized fluid inlet and is arranged substantially parallel to the body of the pneumatic cylinder, said elongate body having at one end a through bore substantially at right angles thereto;

ii. an elongate hollow bolt sealingly mounted in said through bore, said bolt forming said internal channel and having at a first end thereof a threaded portion sealingly mounted in the body of the cylinder and at a second end thereof a tightening head which forms a housing;

iii. a hollow elongate member mounted in said housing, said hollow member forming the said control inlet at a first end thereof and said valve member being slidably mounted at a second end thereof which forms said control chamber; said by-pass channel portion having an orifice and said valve member closing the said orifice in said first position and opening said orifice in said second position, and iv. an exhaust passage formed between said housing and said hollow member.

3. A drain device comprising:

i. an elongate hollow body which forms a pressurized fluid inlet and has at one end a through bore substantially at right angles thereto;

ii. an elongate hollow bolt sealingly mounted in said through bore, said bolt forming an internal channel and having at a first end thereof a threaded portion and at a second end thereof a tightening head which forms a housing, iii. a hollow elongate member mounted in said housing, said hollow member forming a fluid pressure control inlet at a first end thereof and a floating valve member being slidably mounted at a second end thereof; said internal channel having a by-pass channel portion having an orifice and said valve member closing the said orifice in a first position thereof and opening said orifice in a second position thereof, and iv. an exhaust passage formed between said housing and said hollow member.

* * * * *